US005547615A

United States Patent [19]

Jané et al.

[11] Patent Number: 5,547,615

[45] Date of Patent: Aug. 20, 1996

[54] PORTABLE HUMIDIFIER WITH BACTERIASTAT DISPENSER

[75] Inventors: Rodney B. Jané, Westboro, Mass.; Jerald A. Bradley, East Providence, R.I.; John Longan, Natick, Mass.

[73] Assignee: Duracraft Corporation, Southborough, Mass.

[21] Appl. No.: 438,583

[22] Filed: May 10, 1995

[51] Int. Cl.[6] ..... B01F 3/04

[52] U.S. Cl. ..... 261/24; 261/104; 261/DIG. 46; 261/72.1; 222/457; 222/479

[58] Field of Search ..... 261/DIG. 46, 104, 261/24, 72.1; 222/83, 456, 457, 479

[56] References Cited

U.S. PATENT DOCUMENTS

| | | | |
|---|---|---|---|
| 2,573,802 | 11/1951 | Mitchell | 222/457 |
| 2,913,734 | 11/1959 | O'Hare | 222/457 |
| 3,497,453 | 2/1970 | Yurdin | 261/DIG. 46 |
| 4,063,666 | 12/1977 | Downing et al. | 222/457 |
| 4,257,989 | 3/1981 | Nishikawa | 261/DIG. 46 |
| 4,279,241 | 6/1981 | Stewart et al. | 261/DIG. 46 |
| 4,701,286 | 10/1987 | Stillman et al. | 261/DIG. 46 |
| 4,811,871 | 3/1989 | Wass et al. | 222/456 |
| 5,273,687 | 12/1993 | Osborne | 261/DIG. 46 |
| 5,403,521 | 4/1995 | Takahashi | 261/DIG. 46 |
| 5,460,718 | 10/1995 | Weck et al. | 261/DIG. 46 |

*Primary Examiner*—Tim R. Miles

*Attorney, Agent, or Firm*—John E. Toupal; Harold G. Jarcho

[57] ABSTRACT

A portable humidifier including a base defining a reservoir for retaining liquid, a humidification device for inducing dispersion of liquid withdrawn from the reservoir and a liquid storage tank having an outlet for feeding liquid into the reservoir. Also included is a container defining a chamber for a given volume of a treatment substance for liquid and a discharge opening providing communication between the chamber and the tank, and a dispenser for automatically and periodically dispensing through the discharge opening to the tank a dose portion of the treatment substance contained volume within the chamber.

20 Claims, 7 Drawing Sheets

PORTABLE HUMIDIFIER WITH BACTERIASTAT DISPENSER

BACKGROUND OF THE INVENTION

This invention relates generally to a portable electric humidifier and, more particularly, to a portable electric humidifier having an automatic bacteriastat dispenser.

Many types of humidifiers are used to increase environmental humidity. Such humidifiers use a variety of different output mechanisms to disperse, from a supply reservoir, water which has been preconditioned by, for example, atomization, evaporation or vaporization. Generally the supply reservoir is replenished by a supply tank periodically filled with a convenient source of tap water.

Humidifier operating problems are caused by biological organisms existing in the tap water or acquired from the surrounding air. The warm, moist, oxygen rich environment associated with a humidifier provides an excellent habitat for biological growth which can include algeas, slimes, and bacteria. In addition to being unsightly, such growths can foul humidifier operating surfaces resulting in reduced operating efficiency.

Problems associated with biological growth can be significantly reduced by the addition of suitable biocide chemicals such as a bacteriastat to the water employed in the humidifier. Typically, water treatment substances are added to tap water used to fill a storage tank which provides a controlled flow of water to the humidifier's operating reservoir. However, the addition of water treatment materials during each tank refilling operation is tedious and time consuming. Consequently, water treatment procedures often are ignored resulting in biological growth that decreases operating efficiency.

Disclosed in the prior art are systems for controlling biological growth in portable humidifiers. For example, U.S. Pat. No. 4,663,091 discloses an electrode system for water sterilization; U.S. Pat. No. 5,110,511 discloses a system for timed release of a biocide; and U.S. Pat. No. 5,248,454 discloses a water supply tube coated with an algicide. Also, U.S. Pat. No. 4,701,286 discloses an evaporative cooler having a dispenser. However, none of the prior control systems has been economically and operationally suitable for conventional portable humidifiers.

The object of this invention, therefore, is to provide an improved portable humidifier that alleviates operating problems associated with biological growth.

SUMMARY OF THE INVENTION

The invention is a portable humidifier including a base defining a reservoir for retaining liquid, a humidification device for inducing dispersion of liquid withdrawn from the reservoir, and a liquid storage tank having an outlet for feeding liquid into the reservoir. Also included is a container defining a chamber for a given volume of a treatment substance for liquid and a discharge opening providing communication between the chamber and the tank, and a dispenser for automatically and periodically dispensing through the discharge opening to the tank a dose portion of the treatment substance volume contained within the chamber. Periodic dispensing of a suitable treatment substance into the tank insures for the reservoir an available liquid supply of desired quality.

According to one feature of the invention, the tank is removably mounted on the base and defines a fill opening for accommodating a filling operation, and the dispenser dispenses a dose portion of the treatment substance volume in response to each filling operation. This feature insures for the reservoir a liquid supply having a predetermined composition of tap water and treatment substance.

According to other features of the invention, the dispenser has an orifice communicating with the discharge opening and a valve for inducing discharge of a dose portion of the treatment substance volume in response to each filling operation. The valve provides the desired dose dispensing function.

According to still other features of the invention, the valve is movable by gravity between open and closed positions in response to predetermined movements of the dispenser which is mounted on the tank so as to be movable therewith. This feature provides the desired dispensing function with an inexpensive valve mechanism.

According to yet other features of the invention, the fill opening is disposed in a lower portion of the tank and covered with a removable cap, and the valve assumes the open position in response to an inverted orientation of the tank and the closed position in response to an upright orientation thereof. These features automatically establish desired valve operation in response to required manipulation of the tank during a filling operation.

According to a further feature of the invention, the dispenser defines a dosage cavity disposed below the orifice and communicating with an interior portion of the tank. The dosage cavity receives and dispenses sequential doses of the treatment substance.

According to additional features of the invention, the dosage cavity is formed by a cup secured to the valve and having an upwardly projecting edge with the tank in an inverted position; and the dispenser further defines a hollow sleeve surrounding the orifice, projecting downwardly therefrom and having a lower edge disposed below the upwardly projecting edge of the cup. These features establish doses of desired volume with an inexpensive dosage mechanism.

According to important individual features of the invention, the dispenser is detachably engaged with the container, the discharge opening is covered by a rupturable seal, and the valve includes a projection portion for rupturing the seal to open the discharge opening in response to engagement of the dispenser with the container. Providing the humidifier with treatment substance refill containers is simplified by these structural features.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
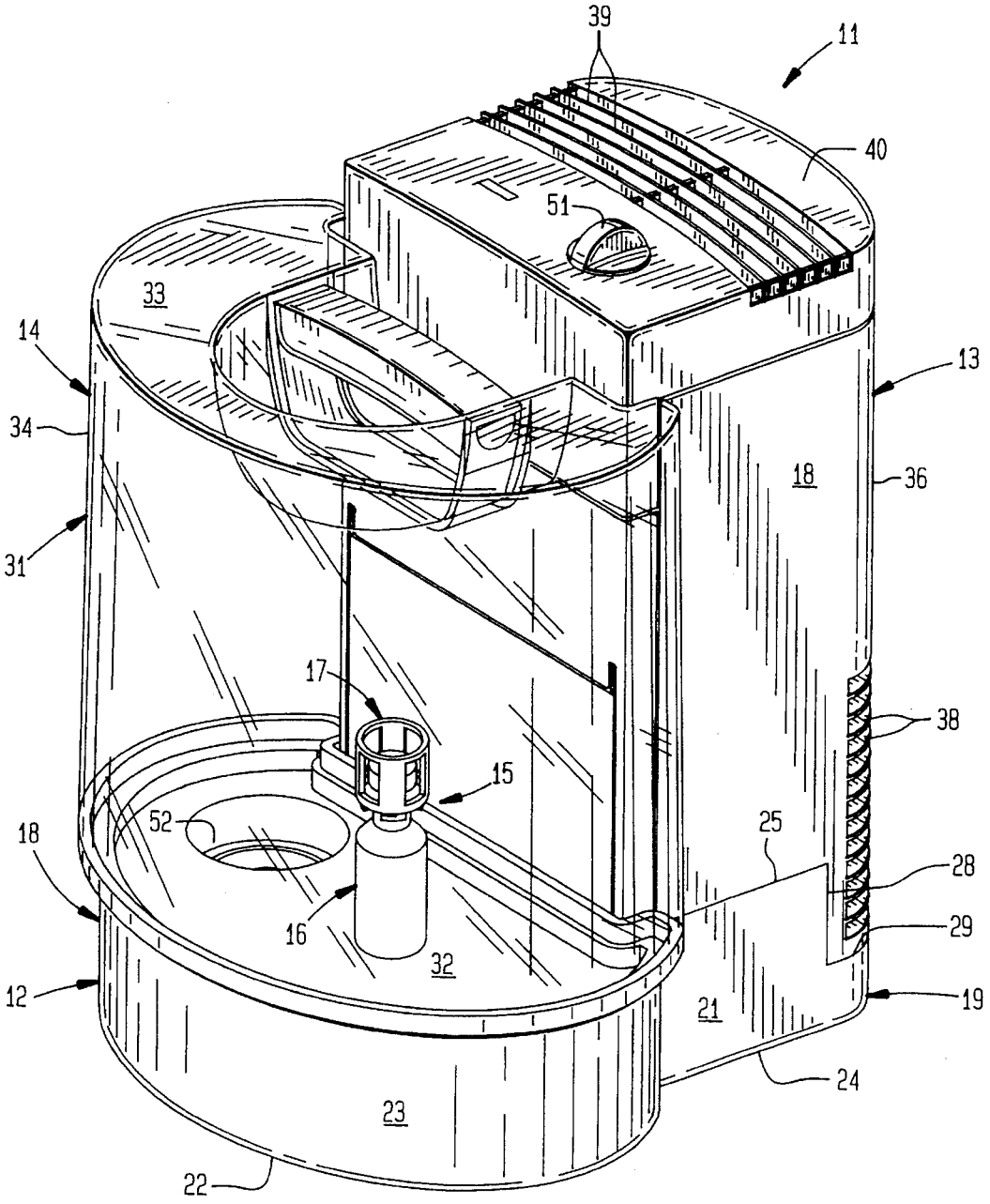
FIG. 1 is a front perspective view of a humidifier according to the invention.

A humidifier 11 includes a base 12, a humidification unit 13 having an upright housing portion 18 and a removable liquid storage tank 14 both mounted on the base 12, and a water treatment substance dispensing assembly 15 including a container 16 and a dispenser 17 removably mounted within the tank 14. The base 12 is generally key-shaped from top view including a circular portion and a rectangular portion 19 as shown in FIG. 1. A peripheral wall 23 extends upwardly from a circular bottom surface 22 of the base 12, and an upright housing portion 21 projects upwardly from a bottom surface 24 of the rectangular portion 19. Extending upwardly from the peripheral wall 21 of the base 12 is a horizontal top surface 25 of the upright housing portion 18. An inner vertical wall 28 projects downwardly from the horizontal top surface 25 to meet an outer upper edge 29 of the rectangular portion 19.

The tank 14 includes an inverted cup-shaped housing 31 and a lid portion 32 permanently sealed in an open bottom end thereof and forming a bottom wall. A substantially planar top wall 33 of the tank 14 is joined to the bottom wall 32 by vertical side wall portions 34 of the housing 31. The horizontally positioned lid portion 32 is supported on a top edge 35 of the peripheral wall 23 of the base portion 12. Extending through an outer peripheral wall 36 of the housing portion 16 are air intake openings 38 while exhaust openings 39 project through a horizontal top surface 40 thereof. The cap/valve assembly 55 consists of a cylindrical cap 56, a valve plunger 57, a rubber valve seal 58, and a compression spring 59. Formed on the cylindrical cap 56 are an outer male threaded cylindrical wall 61, a horizontal circular bottom wall 62 and an axial discharge opening 63. The valve plunger 57 is loosely positioned through the opening 63 to allow axial movement of the plunger 57 relative to the cap 56. Attached to the top end of the valve plunger 57 is the valve seal 58 and the spring 59 is compressed between the cap 56 and a lower end of the plunger 57 to bias the rubber valve seal 58 towards the axial discharge opening 63.

Within the base 12 is removably positioned a tray 65 defining a reservoir 66. The tray 65 has a "tee" shaped horizontal bottom surface 68 with a peripheral wall 69 extending upwardly therefrom. Also extending upwardly from the horizontal bottom surface 68 of the tray 65 is a cylindrical valve actuator post 71 positioned directly below and concentric with the cap/valve assembly 55 of the tank 14. Within the reservoir 66 and in the rectangular portion 19 of the base 12 is positioned an evaporative wick pad 73 which extends upwardly into the upright housing portion 16 and within an airstream path therethrough.

Figure 4:
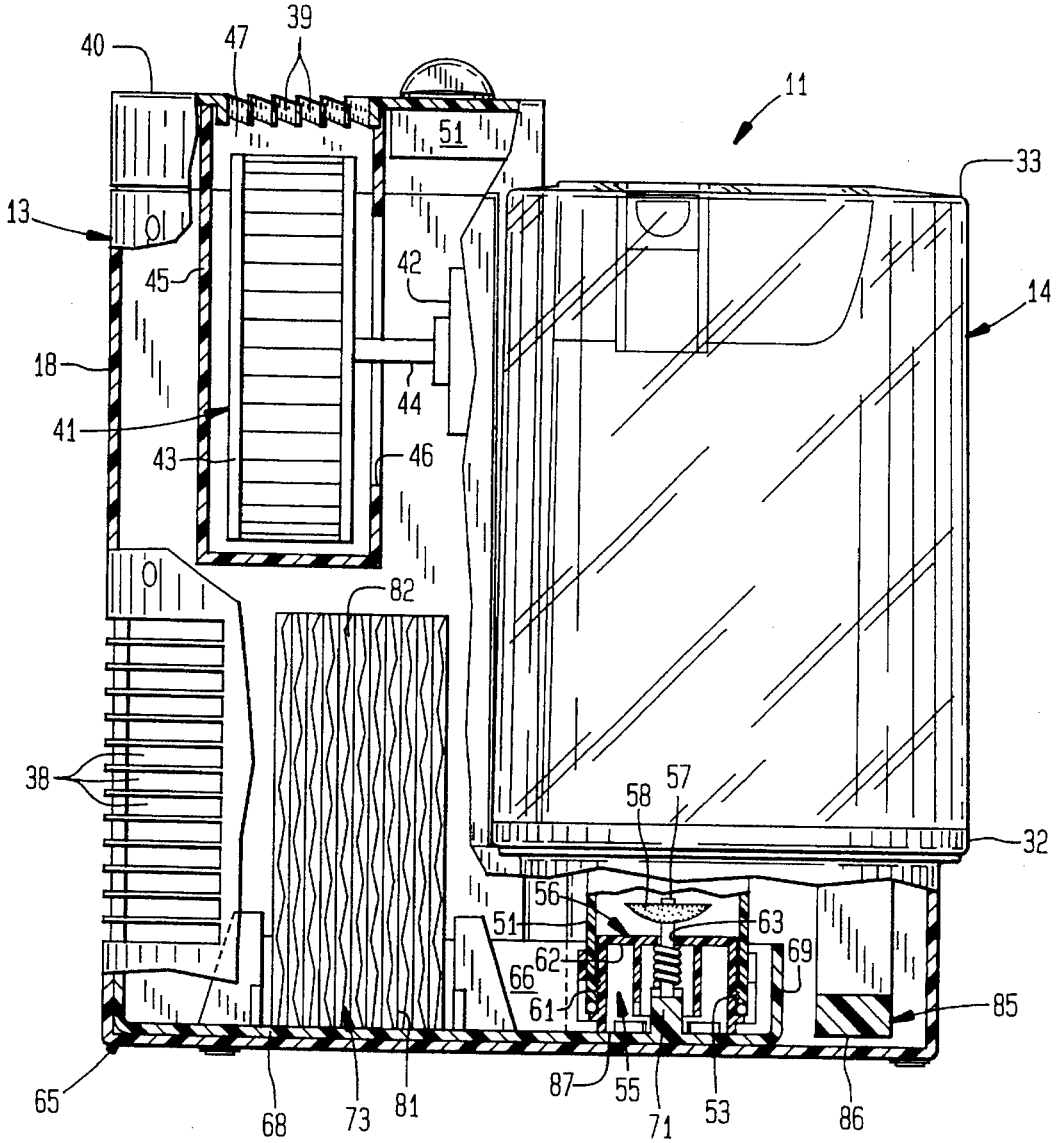
FIG. 4 is a cross-sectional view taken along lines 4—4 in FIG. 3.

As shown in FIG. 4, a blower assembly 41 is mounted below the horizontal top surface 40 and within the housing 18. Included in the blower assembly 41 is a motor 42, a horizontally oriented cylindrical blower wheel 43 mounted on a motor shaft 44, and a blower housing 45. Defined by the blower housing 45 are an air intake opening 46 and an exhaust opening 47 aligned with and adjacent to the exhaust openings 39 of the upright housing 18. When a control switch 51 mounted on the horizontal top surface 25 is closed, the motor 42 is energized to produce rotation of the shaft 44. Resultant spinning of the blower wheel 43 draws air into the housing 18 through the intake openings 38, through the interior of the housing 18, through the intake opening 46 of the blower housing 45, and then out of the humidifier 11 through the air exhaust opening 47 of the blower housing 45 and the exhaust openings 39 in the horizontal top surface 40.

Figure 7:
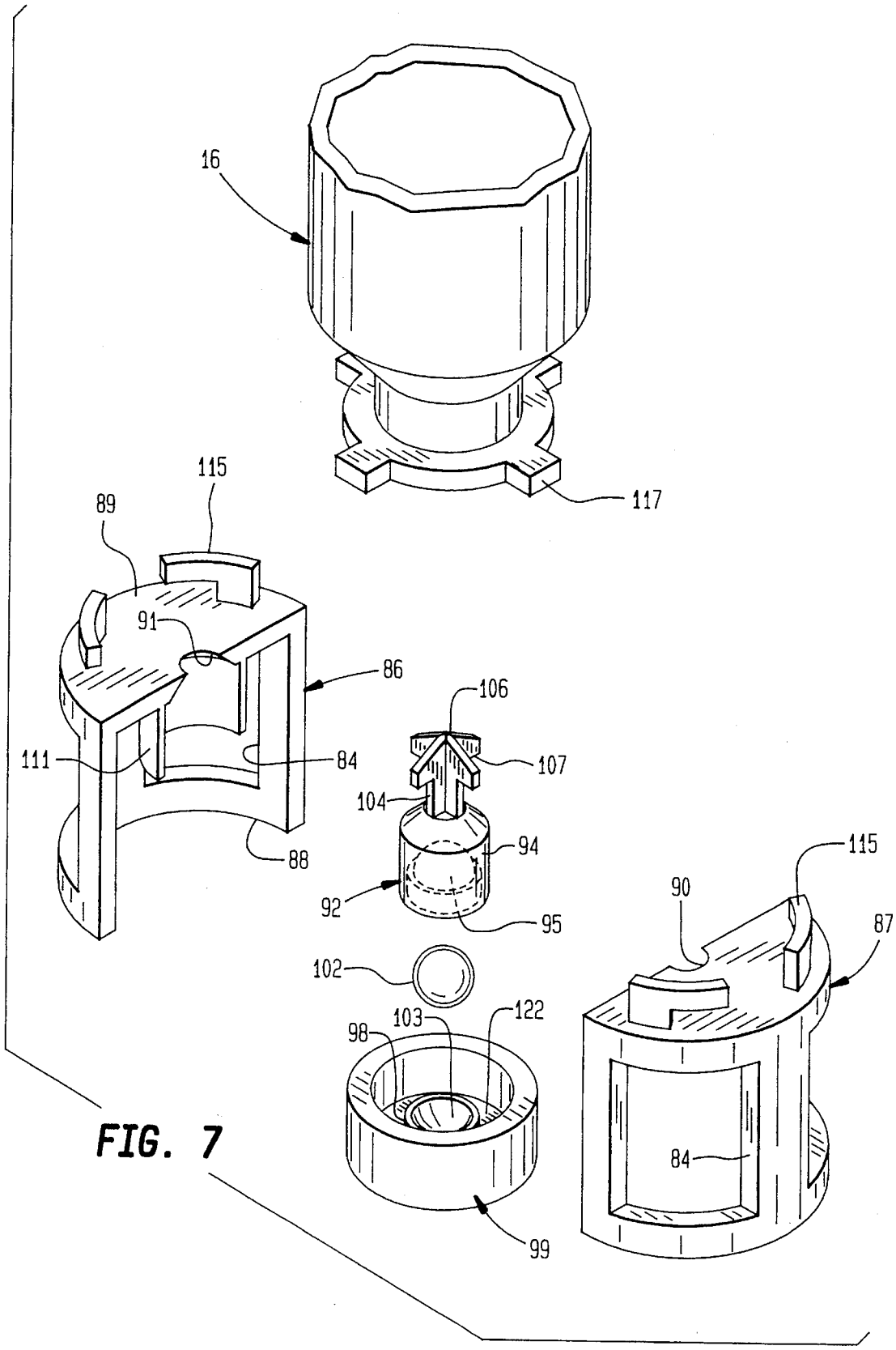
FIG. 7 is an exploded view of the dispensing system.

Depending downwardly from the lid 32 of the tank 14 is a tubular projection 51 with a hollow interior defining female threads 53 (FIG. 7). The tubular projection 51 together with an adjacent opening 52 (FIG. 1) through the lid 32 constitute a water fill opening and discharge opening for the tank 14. A cap/valve assembly 55 is engaged within the threads 53 of the tubular projection 51.

After being filled with water and attached to the cap/valve assembly 55, the tank 14 is positioned on the peripheral wall 23 of the base 12. With the tank 14 in that upright position, the valve actuator 59 in the reservoir 66 pushes the valve plunger 57 upwardly to remove the rubber valve seal 58 away from the axial discharge opening 63 of the cap 56. Water then flows from the tank 14 through the axial discharge opening 63 into the reservoir 66. As water escapes from the tank 14, air simultaneously enters the tank through the axial opening 63. The water level rises until reaching the level of the horizontal bottom wall 62 of the cap 56. At that time water seals the air path into the tank 14 and preventing further discharge of water from the tank 14.

Water in the reservoir 66 is absorbed by a lower portion 81 of the wicking pad 73 and drawn by capillary action upward into an upper portion 82 thereof. The water in the upper portion 82 is subjected to the airstream through the upright housing 16 which airflow accelerates the evaporation of moisture and causes the humidification desired of the humidifier 11. As water is depleted from the reservoir 66 by this humidification, the water level attempts to fall, but thereby exposes the horizontal bottom wall 62 of the cap 56 to allow air to enter the tank 14 and water to thereby escape therefrom. In this manner, the water in the reservoir 66 is maintained at its normal operating level until such time as the tank's water supply has been depleted.

Figure 2:
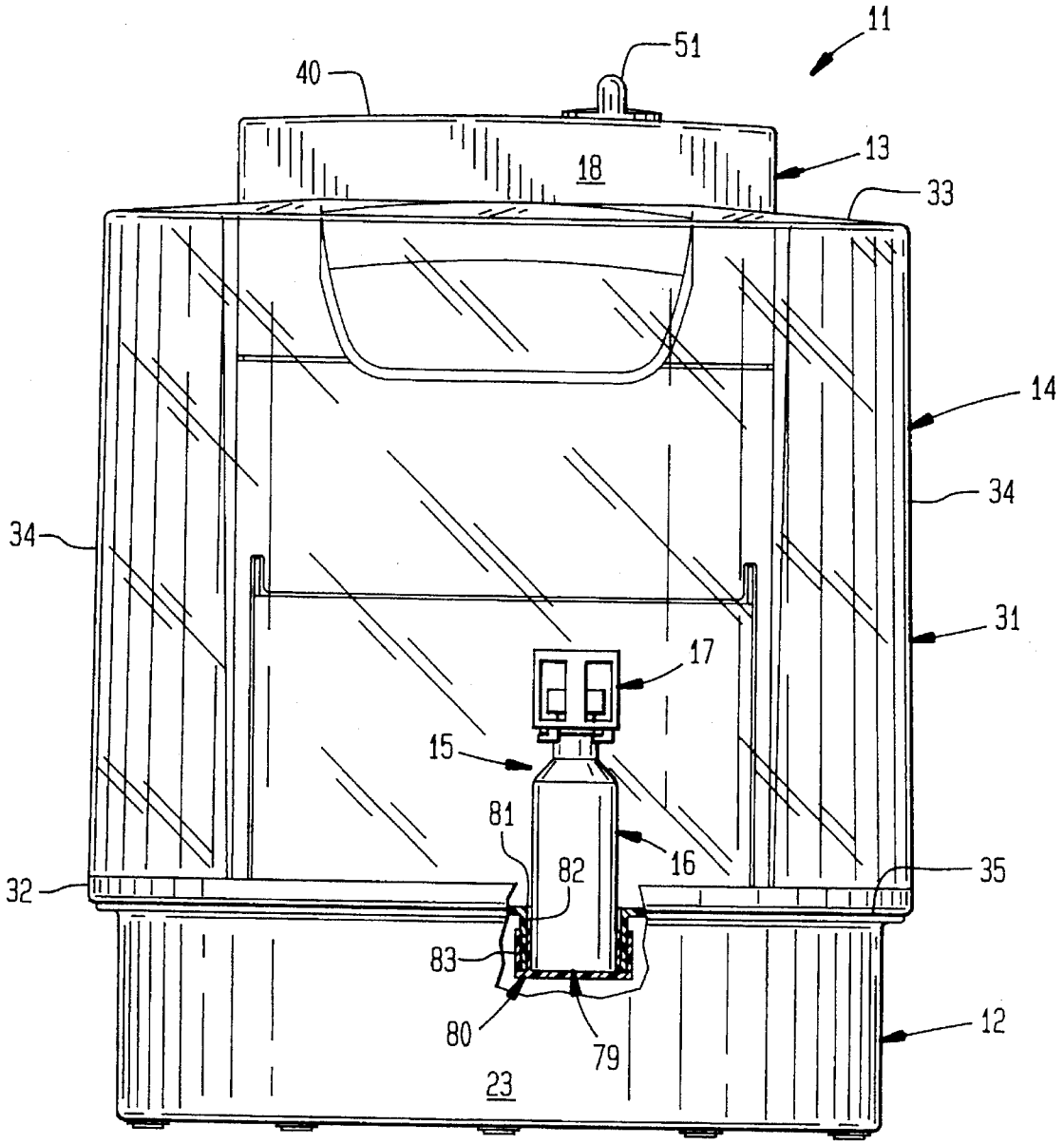
FIG. 2 is a front elevational view of the humidifier.
Figure 3:
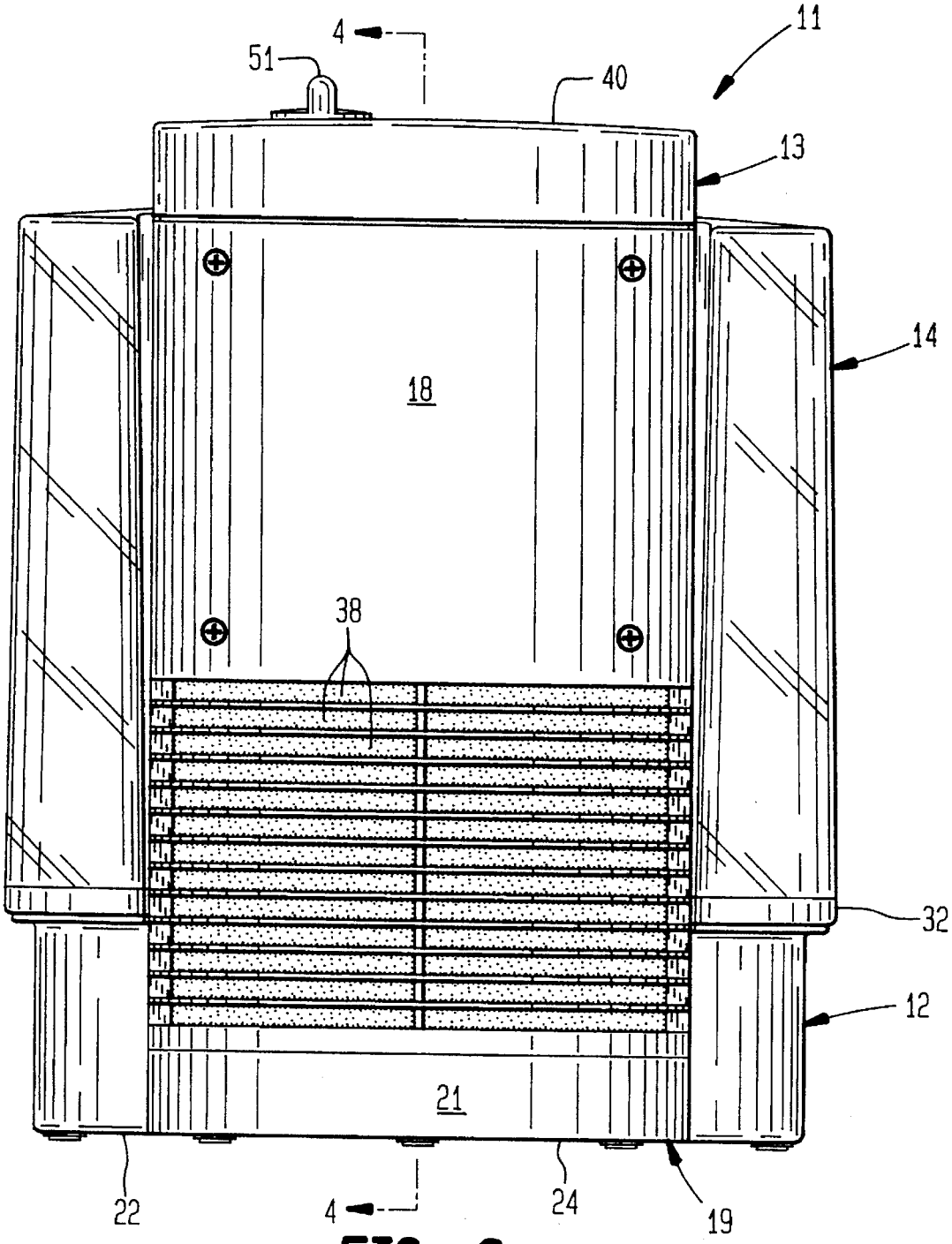
FIG. 3 is a rear elevational view of the humidifier.

Referring now to FIGS. 4–7, the water treatment assembly 15 will be described. The container bottle 16 is filled with a suitable water treatment substance such as a bacteriastat. Defined at one end of the container bottle 16 is a discharge opening 76 that is initially sealed with a rupturable seal 77. An opposite closed end 79 of the container bottle 16 projects through an opening 81 in the bottom wall 32 of the storage tank 14 (FIG. 2). The end 79 is press fitted into a cylindrical recess in a cap member 80. Extending downwardly from the opening 81 is an externally threaded sleeve 82 that engages an internally threaded skirt portion 83 of the cap member 80.

Figure 6:
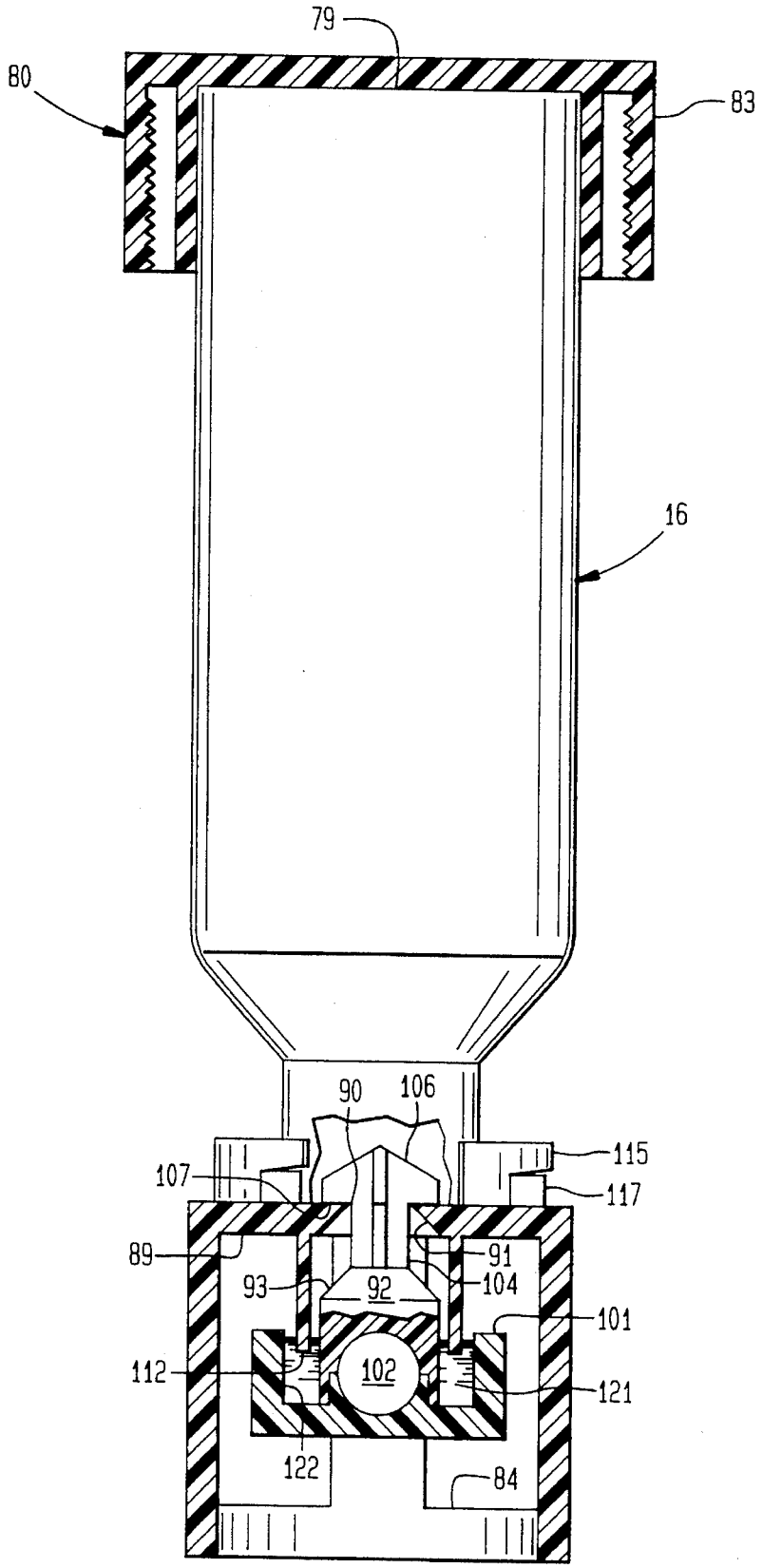
FIG. 6 is a cross-sectional view of the dispensing system in a different operation position.

The dispenser 17 includes a hollow cylindrical body portion 85 formed by longitudinally symmetrical halves 86, 87. Defined in each of the halves 86, 87 are holes 84 that communicate with the interior portion of the supply tank 14. One end 88 of the body portion 85 is open while an opposite closed end 89 defines an orifice 90 surrounded by a conically shaped valve seat 91 communicating with the discharge opening 76 in the container bottle 16. Retained within the body portion 85 is a valve 92 having a conical closure portion 93 shaped for sealing engagement with the seat 91 and a hollow shank portion 94 having a longitudinal recess 95 terminating internally with a spherical surface 96. Press fitted into the longitudinal recess 95 is a centrally located internal stem 98 projecting outwardly from a bottom wall of a cup member 99 having an upwardly projecting edge 101 (FIG. 6). A steel ball weight 102 is retained between the spherical surface 96 on the valve shank 94 and a spherical surface 103 formed at the end of the stem 98 on the cup member 99. Extending longitudinally from the valve closure portion 93 in a direction opposite to the cup member 99 are a pair of crossed arrow shaped portions 106. Each of the arrow portions 106 has a stem portion 104 extending through the orifice 90 and a outwardly projecting shoulder portion 107 that engages an outer surface of the end wall 89 of the body portion 85 (FIG. 6). Extending inwardly from the end wall 89 is a hollow sleeve 111 surrounding the seat 91 and having a lower edge (FIG. 6) 112 disposed below the upwardly projecting edge 101 of the cup member 99. Bayonet type latch arms 115 projecting outwardly from the end wall 89 of the body portion 85 detachably engage latch portions 117 on one end of the container bottle 16.

Figure 5:
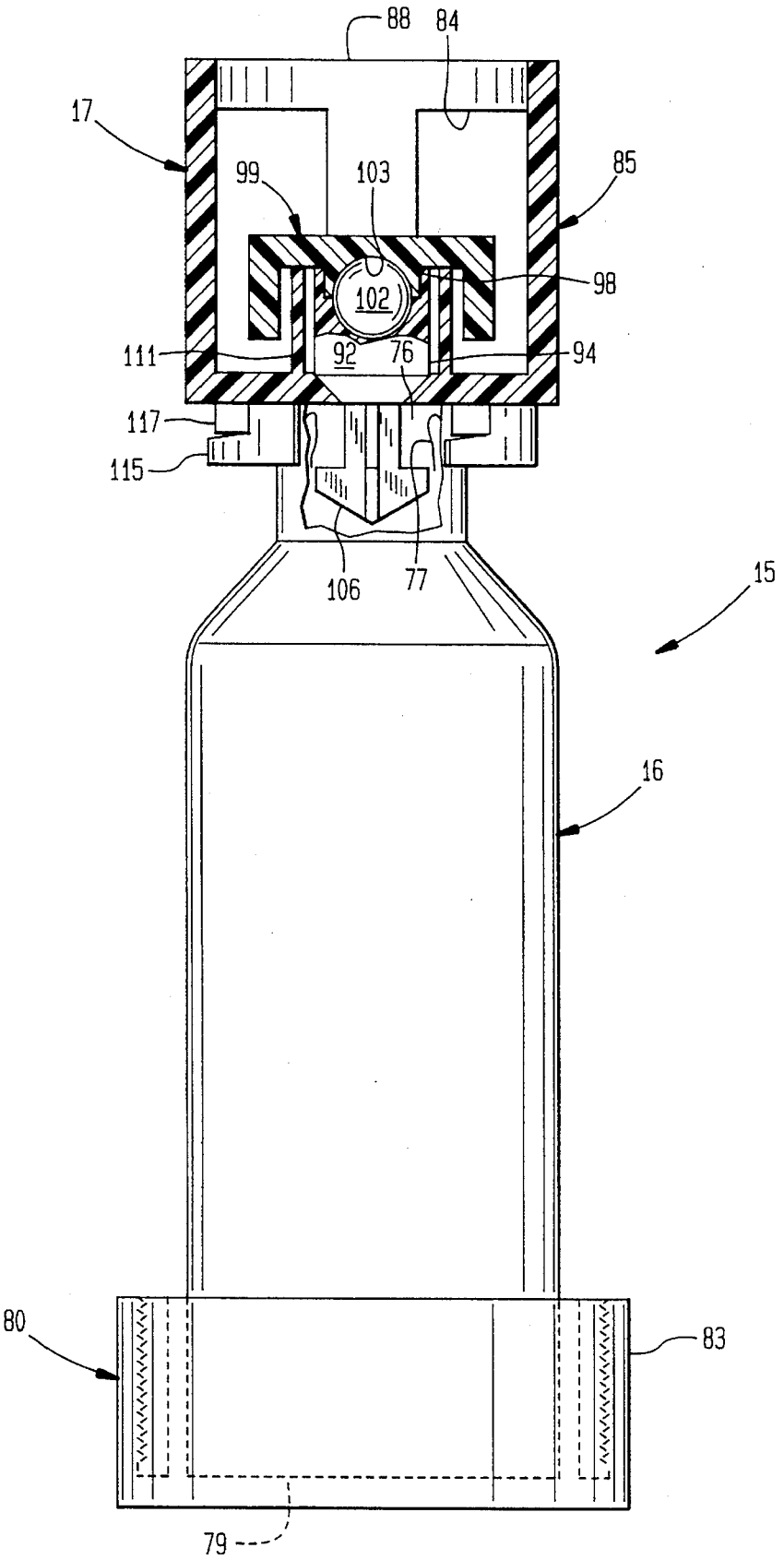
FIG. 5 is a cross-sectional view of a dispensing system of the humidifier shown in one operating position.

Prior to use of the humidifier 11, the dispenser 17 is detachably secured to a container bottle 16. Securement is obtained by producing relative rotation between the container 16 and the dispenser 17 to engage the latch arms 115 with the latch portions 117 as shown in FIGS. 5 and 6. During this assembly of the dispenser assembly 15, the arrow portions 106 on the valve assembly 92 pierce the rupturable seal 77 in the discharge opening 76 to thereby establish communication between the interior of the container bottle 16 and the orifice 90 in the body portion 85. The water treatment assembly 15 then is inserted through the opening 81 in the bottom wall 32 of the tank 14 and secured therein (FIG. 2) by engaging the skirt 83 on the container bottle 16 with the sleeve 82 on the bottom wall 32. Next, the tank 14 is inverted and the cad 55 removed to facilitate a tank filling operation through the fill opening 52.

With the tank 14 in an inverted orientation for the filling operation, the water treatment assembly 15 assumes the position shown in FIG. 6 wherein gravity moves the valve assembly 92 downwardly in the body portion 85 until the shoulder portions 107 on the arrows 106 engage the end wall 89. In that open position, the closure portion 93 is separated from the valve seat 91 so as to establish communication between the container bottle 16 and the cup member 99 via the orifice 90 and the discharge opening 76. Consequently, liquid treatment substance 121 from the container bottle 16 flows into a dosage cavity 122 in the cup member 99 until reaching a vertical level established by the lower edge 112 of the sleeve 111 on the body portion 85. The resultant liquid seal of the hollow sleeve 111 creates within the container bottle 16 a vacuum pressure that terminates treatment substance flow and provides within the dosage cavity a predetermined dose of the treatment substance 121. When the level of water within the tank 14 rises above the upwardly projecting edge 101 of the cup member 99 (FIG. 6) water enters the cup member 99 via the holes 84 in the body portion 85. Consequently, mixing occurs between the water in the tank 14 and the treatment substance dose 121 in the dosage cavity 122 formed by the cup member 99.

After replacement of the cap 55, the water filled tank 14 is again positioned in an upright orientation on the base 12 as shown in FIGS. 1–4. That produces for the water treatment assembly 15, the orientation shown in FIG. 5 allowing gravity to force the valve assembly 92 downwardly and creating a seal between the closure portion 93 and the seat 91 in the body portion 85. In that closed position, the valve 92 prevents the flow of liquid treatment substance between the container bottle 16 and the supply tank 14. Thus, the water treatment assembly 15 automatically produces, into the tank 14, the discharge of a predetermined dose of liquid treatment substance in response to each filling operation. After a given number of tank filling operations have completely dissipated the treatment substance content of a container bottle 16, the water treatment assembly 15 is removed from the supply tank 14 and a replacement container bottle 16 is detachably secured to the dispenser 17 in the manner described above.

Obviously, many modifications and variations of the present invention are possible in light of the above teachings. It is to be understood, therefore, that the invention can be practiced otherwise than as specifically described.

What is claimed is:

1. A portable humidifier with a bacteriastat dispenser and comprising:

a base defining a reservoir for retaining liquid;

a humidification device for inducing dispersion of liquid withdrawn from said reservoir;

a liquid storage tank having an outlet communicating with said reservoir and adapted to feed liquid thereto;

a container defining a chamber for containing a given volume of a treatment substance for liquids and discharge opening providing communication between said chamber and said tank; and a dispenser for automatically and periodically dispensing through said discharge opening to said tank a dose portion of said treatment substance volume within said chamber.

2. A humidifier according to claim 1 wherein said tank is removably mounted on said base and defines a fill opening for accommodating a filling operation of said tank with liquid.

3. A humidifier according to claim 2 wherein said dispenser is adapted to dispense a said dose portion of said treatment substance volume in response to each said filling operation.

4. A humidifier according to claim 3 wherein said dispenser comprises an orifice communicating with said discharge opening and a valve for inducing through said orifice discharge of a dose portion of said treatment substance volume in response to each said filling operation.

5. A humidifier according to claim 4 wherein said valve is movable by gravity between open and closed positions in response to predetermined movements of said dispenser.

6. A humidifier according to claim 5 wherein said dispenser is mounted on said tank so as to be movable therewith.

7. A humidifier according to claim 6 wherein said fill opening is disposed in a lower portion of said tank and including a removable cap for said fill opening.

8. A humidifier according to claim 7 wherein said valve is adapted to assume said open positions in response to an inverted orientation of said tank, and to assume said closed position in response to an upright orientation thereof.

9. A humidifier according to claim 8 wherein said dispenser defines a dosage cavity disposed below said orifice and communicating with an interior portion of said tank.

10. A humidifier according to claim 9 wherein said dosage cavity is formed by a cup secured to said valve and having an upwardly projecting edge with said tank in said inverted position, and said dispenser further defines a hollow sleeve surrounding said orifice and projecting downwardly therefrom with said tank in said inverted position, said hollow sleeve having a lower edge disposed below said upwardly projecting edge of said cup.

11. A humidifier according to claim 10 wherein said orifice defines an annular seat, and said valve is moved into a seated position on said seat in response to an upright orientation of said tank.

12. A humidifier according to claim 1 wherein said dispenser is detachably engaged with said container.

13. A humidifier according to claim 12 wherein said container includes a frangible seal over said discharge opening, and said valve includes a projection portion for rupturing said seal to open said discharge opening in response to engagement of said dispenser with said container.

14. A humidifier according to claim 13 wherein said tank is removably mounted on said base and defines a fill opening for accommodating a filling operation of said tank with liquid.

15. A humidifier according to claim 14 wherein said dispenser is adapted to dispense a said dose portion of said treatment substance volume in response to each said filling operation.

16. A humidifier according to claim 15 wherein said dispenser comprises an orifice communicating with said discharge opening and a valve for inducing through said orifice discharge of a dose portion of said treatment substance volume in response to each said filling operation.

17. A humidifier according to claim 16 wherein said valve is movable by gravity between open and closed positions in response to predetermined movements of said dispenser.

18. A humidifier according to claim 17 wherein said dispenser is mounted on said tank so as to be movable therewith.

19. A humidifier according to claim 18 wherein said fill opening is disposed in a lower portion of said tank and including a removable cap for said fill opening.

20. A humidifier according to claim 19 wherein said valve is adapted to assume said open position in response to an inverted orientation of said tank, and to assume said closed position in response to an upright orientation thereof.

* * * * *